US008287299B2

(12) United States Patent
Ray et al.

(10) Patent No.: US 8,287,299 B2
(45) Date of Patent: Oct. 16, 2012

(54) HDMI PLUG AND CABLE ASSEMBLY WITH IMPROVED RETENTION FEATURES

(75) Inventors: Craig Dwayne Ray, Fuquay-Varina, NC (US); Joseph Mayor, Rancho Santa Margarita, CA (US)

(73) Assignee: All Systems Broadband, Inc., Livermore, CA (US)

( * ) Notice: Subject to any disclaimer, the term of this patent is extended or adjusted under 35 U.S.C. 154(b) by 191 days.

(21) Appl. No.: 12/903,731

(22) Filed: Oct. 13, 2010

(65) Prior Publication Data

US 2012/0094522 A1 Apr. 19, 2012

(51) Int. Cl.
*H01R 13/627* (2006.01)

(52) U.S. Cl. ..... 439/353

(58) Field of Classification Search ..... 439/353, 439/357, 358

See application file for complete search history.

(56) References Cited

U.S. PATENT DOCUMENTS

| | | | | |
|---|---|---|---|---|
| 4,337,989 | A * | 7/1982 | Asick et al. | 439/607.23 |
| 6,139,350 | A * | 10/2000 | Mathesius | 439/357 |
| 6,508,678 | B1 * | 1/2003 | Yang | 439/677 |
| 6,902,432 | B2 * | 6/2005 | Morikawa et al. | 439/607.41 |
| 6,997,733 | B2 * | 2/2006 | Peng | 439/353 |
| 7,014,490 | B1 * | 3/2006 | Morikawa et al. | 439/352 |
| 7,033,218 | B2 * | 4/2006 | Huang et al. | 439/607.04 |
| 7,134,900 | B2 * | 11/2006 | Chung | 439/353 |
| 7,160,137 | B1 * | 1/2007 | Yeh | 439/358 |
| 7,175,465 | B1 * | 2/2007 | Tsai | 439/352 |
| 7,252,549 | B2 * | 8/2007 | Nishio et al. | 439/607.55 |
| 7,258,565 | B2 * | 8/2007 | Huang et al. | 439/353 |
| 7,314,383 | B1 * | 1/2008 | Ho et al. | 439/353 |
| 7,329,154 | B2 * | 2/2008 | Koyama | 439/660 |
| 7,422,465 | B2 * | 9/2008 | Watanabe et al. | 439/353 |
| 7,442,066 | B1 * | 10/2008 | Ho et al. | 439/358 |
| 7,455,545 | B2 | 11/2008 | Chawgo et al. | |
| 7,476,118 | B2 | 1/2009 | Amidon | |
| 7,572,139 | B2 | 8/2009 | Montena | |
| 7,614,920 | B1 * | 11/2009 | Yi | 439/682 |
| 7,661,993 | B2 * | 2/2010 | Liu | 439/660 |
| 7,682,182 | B2 * | 3/2010 | Kondo et al. | 439/353 |
| 7,695,304 | B2 * | 4/2010 | Chiang et al. | 439/353 |
| 7,727,027 | B2 * | 6/2010 | Chiang et al. | 439/660 |

(Continued)

OTHER PUBLICATIONS

Author Unknown. "HDMI." Excerpt from Wikipedia, printed Sep. 6, 2010, available online at: http://en.wikipedia.org/wiki/Hdmi.

*Primary Examiner* — Neil Abrams

(74) *Attorney, Agent, or Firm* — Murphy, Bilak & Homiller, PLLC

(57) ABSTRACT

High-definition multimedia interface (HDMI) plugs are modified to include one or more retention features that increase the force needed to extract a fully inserted HDMI plug from a compatible mating receptacle. In several embodiments, a high-definition multimedia interface (HDMI) plug includes a connector body having a mating end configured for insertion in a longitudinal direction into a mating HDMI receptacle and having a slot-shaped opening along at least one wall of the connector body, extending in the longitudinal direction. A movable tab is biased to extend outward from the slot-shaped opening in a first position, when unconstrained by the mating HDMI receptacle, and configured to retreat into a second position, substantially within said opening, when longitudinally engaged by a leading edge of the mating HDMI receptacle during insertion of the connector body. Additional retention features and mating HDMI receptacles are also described.

6 Claims, 5 Drawing Sheets

U.S. PATENT DOCUMENTS

| | | | | |
|---|---|---|---|---|
| 7,753,712 | B2 * | 7/2010 | Miki | 439/353 |
| 7,833,058 | B2 * | 11/2010 | Zhang et al. | 439/607.41 |
| 7,871,297 | B2 * | 1/2011 | Li | 439/607.54 |
| 7,892,014 | B2 * | 2/2011 | Amidon et al. | 439/353 |
| 7,972,182 | B2 * | 7/2011 | Zheng et al. | 439/660 |
| 8,033,853 | B2 * | 10/2011 | Chang | 439/304 |
| 8,043,107 | B2 * | 10/2011 | He | 439/352 |
| 8,083,535 | B2 * | 12/2011 | Chang | 439/357 |
| 8,113,865 | B1 * | 2/2012 | Yang et al. | 439/353 |
| 8,123,562 | B2 * | 2/2012 | Zhou et al. | 439/607.48 |
| 2008/0200058 | A1 * | 8/2008 | Tsai | 439/353 |
| 2009/0075513 | A1 | 3/2009 | Amidon | |
| 2009/0239405 | A1 | 9/2009 | Amidon | |
| 2009/0239406 | A1 | 9/2009 | Amidon | |
| 2010/0285683 | A1 * | 11/2010 | Zhang | 439/357 |
| 2012/0094522 | A1 * | 4/2012 | Ray et al. | 439/357 |

* cited by examiner

| Pin | Signal |
|---|---|
| 1 | TMDS Data2+ |
| 2 | TMDS Data2 Shield |
| 3 | TMDS Data2- |
| 4 | TMDS Data1+ |
| 5 | TMDS Data1 Shield |
| 6 | TMDS Data1- |
| 7 | TMDS Data0+ |
| 8 | TMDS Data0 Shield |
| 9 | TMDS Data0- |
| 10 | TMDS Clock+ |
| 11 | TMDS Clock Shield |
| 12 | TMDS Clock- |
| 13 | CEC |
| 14 | Reserved |
| 15 | SCL |
| 16 | SDA |
| 17 | DDC/CEC Ground |
| 18 | +5V Power |
| 19 | Hot Plug Detect |

*FIG. 4*

| Pin | Signal |
|---|---|
| 1 | TMDS Data2+ |
| 2 | TMDS Data2 Shield |
| 3 | TMDS Data2- |
| 4 | TMDS Data1+ |
| 5 | TMDS Data1 Shield |
| 6 | TMDS Data1- |
| 7 | TMDS Data0+ |
| 8 | TMDS Data0 Shield |
| 9 | TMDS Data0- |
| 10 | TMDS Clock+ |
| 11 | TMDS Clock Shield |
| 12 | TMDS Clock- |
| 13 | TMDS Data5+ |
| 14 | TMDS Data5 Shield |
| 15 | TMDS Data5- |
| 16 | TMDS Data4+ |
| 17 | TMDS Data4 Shield |
| 18 | TMDS Data4- |
| 19 | TMDS Data3+ |
| 20 | TMDS Data3 Shield |
| 21 | TMDS Data3- |
| 22 | CEC |
| 23 | Reserved |
| 24 | Reserved |
| 25 | SCL |
| 26 | SDA |
| 27 | DDC/CEC Ground |
| 28 | +5V Power |
| 29 | Hot Plug Detect |

*FIG. 5*

HDMI PLUG AND CABLE ASSEMBLY WITH IMPROVED RETENTION FEATURES

TECHNICAL FIELD

The present invention relates generally to cable assemblies for use with audio and video equipment.

BACKGROUND

HDMI (High-Definition Multimedia Interface) is a compact audio/video interface for transmitting digital data between equipment, such as between a satellite television receiver or a Digital Video Disc (DVD) player and a television monitor. Previous interconnection technologies, such as radio-frequency (RF) coaxial cable, composite video, S-video, etc., relied on analog transmission. HDMI provides a high-quality digital alternative.

HDMI cables have become increasingly prevalent in consumer applications. This increased deployment coincides with a general increase in complexity associated with household audio and video systems. One problem that has been noted with HDMI cables in particular is a susceptibility to poor or incomplete connections, since the HDMI connectors of standard configuration have a tendency to come loose from movement or vibration of the audio/video equipment. This problem can be quite costly. For instance, cable television operators frequently deploy technicians to consumers' homes to resolve loss-of-picture complaints that turn out to be loose connections at an HDMI port.

Some manufacturers have attempted to address this problem by developing so-called locking HDMI connectors, which include a locking tab that securely engages an opening in a HDMI receptacle, so that the HDMI connector cannot be removed without pushing or sliding a locking button on the connector body. Examples of this approach are illustrated in U.S. Pat. No. 7,455,545, which is incorporated by reference herein in its entirety to provide context and technical background for the various improvements described below.

Locking connectors, however, can damage the receptacle and/or the video equipment if the connector is pulled too hard without manually disengaging the locking feature. Thus, alternative or improved designs are still needed.

SUMMARY

High-definition multimedia interface (HDMI) plugs may be modified to include one or more retention features that increase the force needed to extract a fully inserted HDMI plug from a compatible mating receptacle. In several embodiments disclosed herein, a high-definition multimedia interface (HDMI) plug includes a connector body having a mating end configured for insertion in a longitudinal direction into a mating HDMI receptacle and having a slot-shaped opening along at least one wall of the connector body, extending in the longitudinal direction. A movable tab is biased to extend outward from the slot-shaped opening in a first position, when unconstrained by the mating HDMI receptacle, and configured to retreat into a second position, substantially within said opening, when longitudinally engaged by a leading edge of the mating HDMI receptacle during insertion of the connector body. Some embodiments include a second slot-shaped opening in another wall of the connector body, extending in the longitudinal direction, and a second movable tab spring-biased to extend outward from the second slot-shaped opening when unconstrained by the mating HDMI receptacle. This spring-biased tab also retreats into a position substantially within the second slot-shaped opening when longitudinally engaged by the leading edge of the mating HDMI receptacle during insertion of the connector body.

In some embodiments, the movable tab has a forward edge configured to engage a leading edge of the mating HDMI receptacle during insertion of the connector body; this forward edge is disposed at an obtuse angle relative to a ray extending from the first movable tab towards the mating end of the connector body, in the longitudinal direction. The movable tab also has a trailing edge configured to engage an opening in the mating HDMI receptacle during retraction of the connector body therefrom, wherein said trailing edge is disposed at an obtuse angle relative to a ray extending from the first movable tab away from the mating end of the connector body, along the longitudinal axis.

Additional retention features may be included in some embodiments of the HDMI plugs described above. For instance, the connector body in some embodiments further comprises at least one opening in a first face of the connector body, this opening sized and located to accept a first spring-biased tab of the mating HDMI receptacle upon insertion of the connector body Some of these embodiments may include a second opening in a second face of the connector body, opposite the first face, the second opening sized and located to accept a second spring-biased tab of the mating HDMI receptacle upon insertion of the connector body.

Mating HDMI receptacles are also disclosed, including an HDMI receptacle with a receptacle body having a mating end configured to accept a mating HDMI plug having a connector body. This receptacle body has a first opening sized and located to accept a first spring-biased tab extending outward from a slot-shaped opening in the connector body when the HDMI plug is inserted into the HDMI receptacle body in a fully inserted position. The first opening includes a leading edge positioned to engage a trailing edge of the spring-biased tab and to force the spring-biased tab into an orientation substantially within the slot-shaped opening in the connector body during withdrawal of the HDMI plug from the fully inserted position. In some embodiments, the HDMI receptacle further includes a first spring-biased tab sized and located to engage a first opening in a first face of the connector body upon insertion of the connector body into the receptacle body, and a second spring-biased tab sized and located to engage a second opening in a second face of the connector body, opposite the first face, upon insertion of the connector body into the receptacle body.

Of course, the present invention may be carried out in ways other than those set forth in the specific embodiments illustrated herein.

BRIEF DESCRIPTION OF THE DRAWINGS

FIG. 4 lists the electrical pin configuration for a 19-pin HDMI plug.

FIG. 5 lists the electrical pin configuration for a 29-pin HDMI plug.

DETAILED DESCRIPTION

Figure 1:
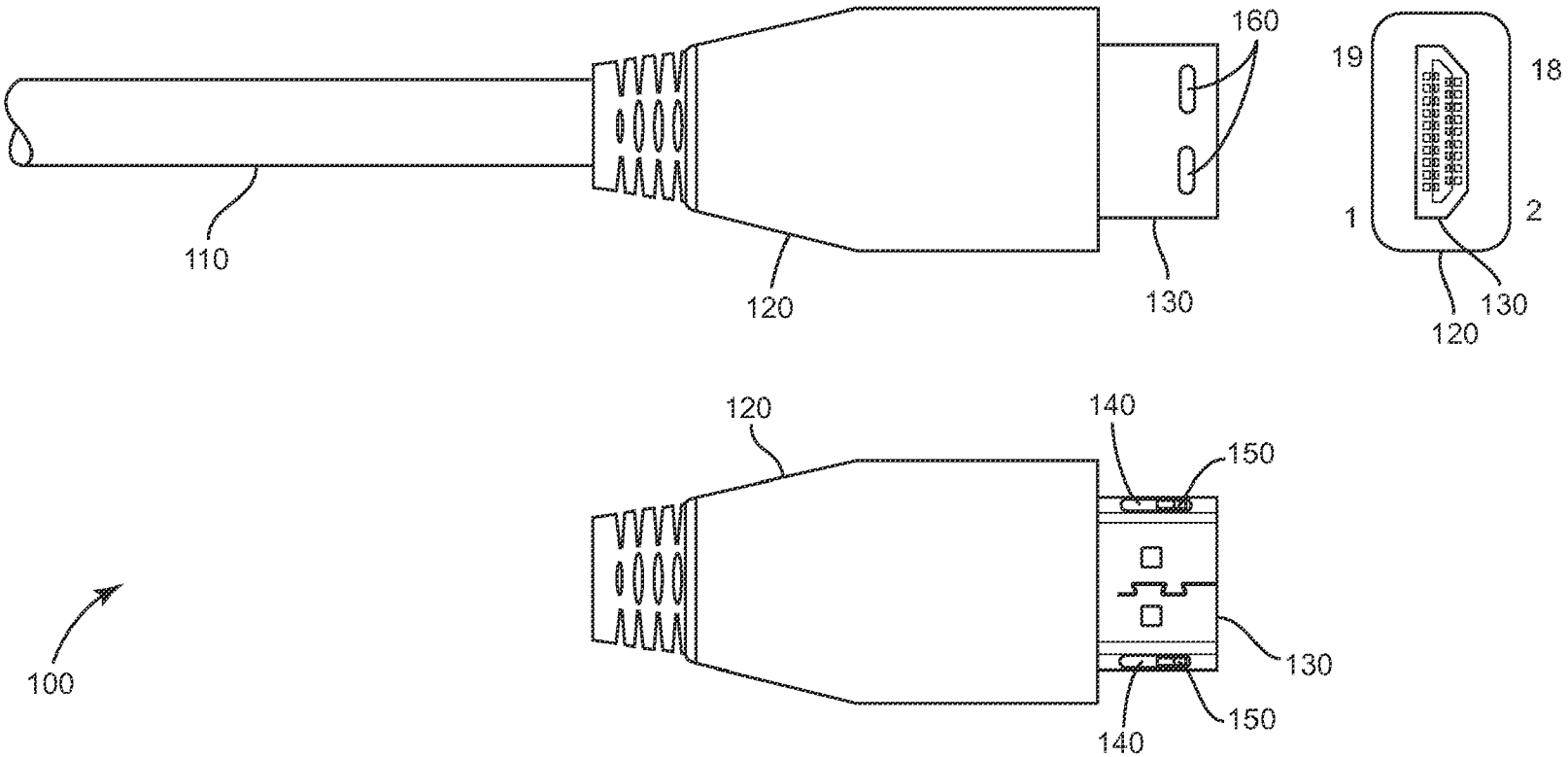
FIG. 1 illustrates several views of an HDMI cable assembly including improved retention features.

While certain embodiments of the present invention are illustrated and are described in detail below, various changes and modifications may be made without departing from the scope of the appended claims. The scope of the present invention is thus not limited to the number of constituting components, materials, shapes, relative arrangement, etc., of the example embodiments disclosed herein. Various features of the present invention are illustrated in detail in the accompanying drawings, wherein like reference numerals refer to like elements throughout the drawings.

FIG. 1 illustrates one end of a High-Definition Multimedia Interface (HDMI) cable assembly 100 according to some embodiments of the present invention. HDMI cable assembly 100 includes a length of cable 110, a plug body 120, and a connector body 130. The connector body 130 includes slot-shaped openings 140, running along the side walls of the body. A movable, spring-loaded tab 150 protrudes from each of these slot-shaped openings 140 when the connector body 130 is not constrained by a mating HDMI receptacle. As will be discussed in further detail below, the movable tabs 150 are configured to retreat into a position at least substantially inside the openings 140 during insertion into a compatible HDMI receptacle, and will extend again to engage a corresponding retaining feature on the HDMI receptacle when the connector body 130 is fully inserted into the receptacle.

Additional openings 160 are disposed on the face of connector body 130 opposite the movable tabs 150. Each of these openings 160 are positioned and sized to accept a spring-biased tab of the mating HDMI receptacle upon insertion of the connector body 130. In a Type A connector, for example, a suitable size and location for each of openings 160 is approximately 1.5 millimeters by about 4.7 millimeters, with the openings positioned about 1.3 millimeters away from the mating edge of connector body 130 and separated from one another by about 3.90 millimeters. A suitable depth for these openings 160, in a Type A connector, is about 0.35 millimeters. The engagement between openings 160 and suitably sized and located mating tabs on the mating receptacle increases the force required to remove the connector body 130 from the receptacle, like the engagement between the movable tabs 150 and the corresponding retention features in the receptacle. Although a plug may be configured with only one or the other of these retention features, these features complement each other, and the maximum benefit is obtained by using both.

Only one end of cable assembly 100 is illustrated in FIG. 1. The other end may terminate in a plug assembly identical to that shown in FIG. 1, in some embodiments. In others, the other end of cable assembly 100 may be terminated with a different plug, with or without one or both of the retention features illustrated in FIG. 1. For instance, the plug assembly pictured in FIG. 1 may correspond to a Type A HDMI plug (with end dimensions of about 13.9 mm×4.45 mm), while the other end of cable assembly 100 may be terminated with a Type C (10.42 mm×2.42 mm) or Type D (6.4 mm×2.8 mm) connector. In still other embodiments the other end of cable assembly 100 may be terminated in a proprietary (i.e., non-standard) connector configuration, for attachment to a particular type of audio or video equipment.

The cable 110 may be of various constructions and qualities. In some embodiments, cable 110 is designed to meet standards specified in the HDMI 1.3 specification for Category 1-certified cables (typically marketed as "Standard" cables) or for Category 2-certified cables (typically marketed as "High Speed" cables). Plug body 120 may be formed from injection-molded rubber, in some embodiments, and securely holds the metallic connector body 130. Connector body 130, in turn, contains nineteen electrical pins in the embodiment pictured in FIG. 1, which may correspond to a Type A or Type C plug, as specified in the HDMI 1.0 and 1.3 specifications, respectively. Other configurations are possible, including the 29-pin Type B plug specified in the HDMI 1.0 specification, and the Type D plug described in the HDMI 1.4 specification.

Figure 2:
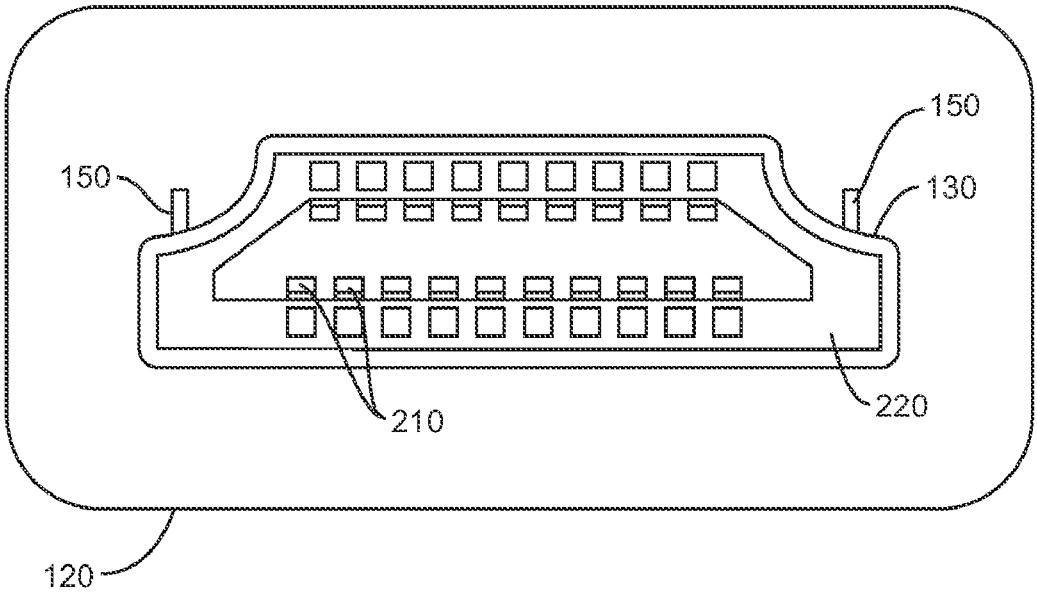
FIG. 2 is an end view of an HDMI plug according to some embodiments of the present invention.
Figure 3:
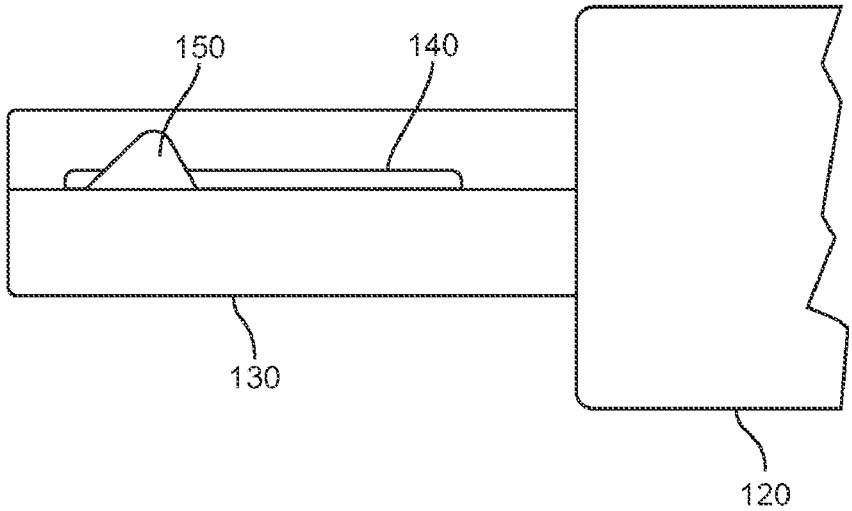
FIG. 3 is a side view of the HDMI plug of FIG. 2.

A closer view of the mating end of the connector body 130 is illustrated in FIGS. 2 and 3. As shown in FIG. 2, connector body 130 houses plug terminal contacts 210 configured to physically and electrically contact corresponding contacts of a typical high-definition multimedia interface receptacle. The illustrated embodiment includes nineteen such terminal contacts, as in either a typical Type A or a typical Type C HDMI connector. Connector body 130 includes an inner section 220, which may be integrally formed with, separately joined to, or removably secured within an outer metallic portion of connector body 130. The plug terminal contacts 210 may be integrally formed as part of the inner section 220, may be separately joined to the inner section 220, or may be removably secured to the inner section 220. The inner section 220 may be formed of conductive materials or of a dielectric material.

As shown in both FIGS. 2 and 3, movable tabs 150 protrude from the connector body 130 in a direction generally perpendicular to the wider dimension of connector body 130. As these figures illustrate, connector body 130 has a first face (on the top, in the view of FIGS. 2 and 3), and a second face opposite the first face and having a second width greater than the first width. At each side of the connector body 130, the transition between these two faces forms a ledge portion running along the length of the connector body 130. As can be seen in FIGS. 1 and 3, the slot-shaped openings 140 are disposed on the ledge portions so that the movable tabs 140 extend outward towards the second face when unconstrained by a mating connector.

FIG. 3 also shows that movable tabs 150 have angled forward and trailing edges, where the forward edge is towards the mating end of the connector body 130. As will be discussed further below, the forward edge is disposed at an obtuse angle relative to the longitudinal insertion axis, so that it engages a leading edge of a mating receptacle upon insertion into the receptacle. This engagement forces the spring-loaded tab down and into the opening 140. When the connector body 130 is fully inserted into the mating receptacle, an appropriately sized and located opening in the receptacle allows the movable tabs 150 to protrude from opening 140 again. The trailing edge of the movable tab 150 engages the opening in the receptacle, resisting any extraction force applied to the connector body 130. It will be appreciated that the obtuse angle of the trailing edge of the spring-loaded movable tab 150, relative to the direction of extraction for the connector body, results in an extraction force that is increased, compared to a connector assembly lacking the spring-loaded movable tab. This increased retention force can be adjusted during the design of the connector, by adjusting the biasing force that tends to push the tab 150 out of the opening 140 or by adjusting the angle of the trailing edge of the tab 150, or both.

FIG. 4 shows the designations for each of the nineteen pins of a Type A or Type D HDMI connector. A Type C connector includes the same electrical connections, but is configured differently. In particular, all positive signals of the differential pairs (e.g. TMDS Data2+ are swapped with their corresponding shields, the DDC/CEC Ground is assigned to pin 13 instead of pin 17, the CEC is assigned to pin 14 instead of pin 13, and the reserved pin is 17 rather than pin 14. FIG. 5 shows the electrical designations for each of the twenty-nine pins of a Type B connector. One or several of the retention features described herein may be implemented on any of these HDMI connector types.

Figure 6:
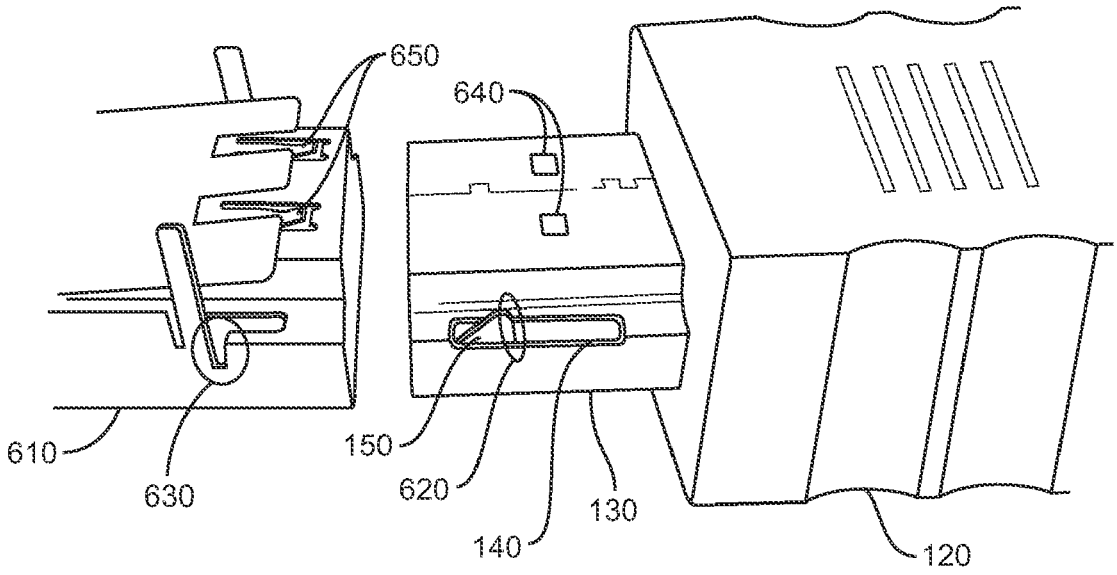
FIG. 6 is a perspective view illustrating an improved-retention HDMI plug and a corresponding HDMI receptacle.

FIG. 6 is a perspective view illustrating the compatibility between the movable tab 150 and a retention feature 630 in mating receptacle 610. Mating receptacle 610 includes an opening that is sized and located to allow the spring-biased movable tab 150 to extend outward from the slot 140 when the connector body 130 is fully inserted into the receptacle 610. More particularly, an edge 630 of the opening in the mating receptacle 610 forms a retention feature that engages the trailing edge 620 of the movable tab 150 when the connector body 130 is fully inserted. As noted earlier, this engagement between the trailing edge 620 and the retention feature 630 increases the force needed to retract the connector body 130 from the receptacle 610; this force is a function of the outward force exerted by the spring biasing of the tab 150 and of the obtuse angle formed by the trailing edge 620 relative to the direction of extraction.

Figure 7:
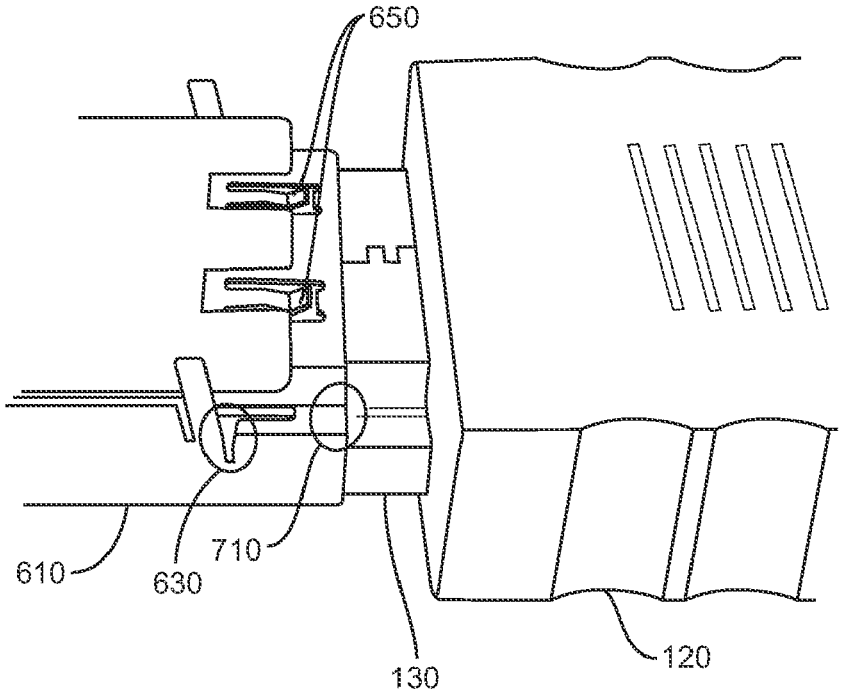
FIG. 7 is a perspective view illustrating the mating between the improved-retention HDMI plug and HDMI receptacle of FIG. 6.

FIG. 7 shows connector body 130 and mating receptacle 610 in a partially mated configuration. As connector body 130 is slid into mating receptacle 610, a leading edge 710 of the mating receptacle 610 engages the forward edge of the movable tab 150 (not visible in FIG. 7), forcing the movable tab into the slot 140. Likewise, when the connector body 130 is retracted from the mating receptacle 610, after being fully inserted, the retention feature 630 engages with the trailing edge of movable tab 150, again forcing the tab 150 into the slot 140 until the connector body 130 is removed.

Also shown in FIGS. 6 and 7 is an additional retention feature, comprising the interaction between openings 640, on the face of connector body 130, and the spring-biased tabs 650 located on the mating receptacle 610. When connector body 130 is fully inserted into the receptacle 610, the spring-biased tabs 650 engage the openings 640, thus increasing the force needed to extract the connector body 130 from the receptacle 610.

Figure 8:
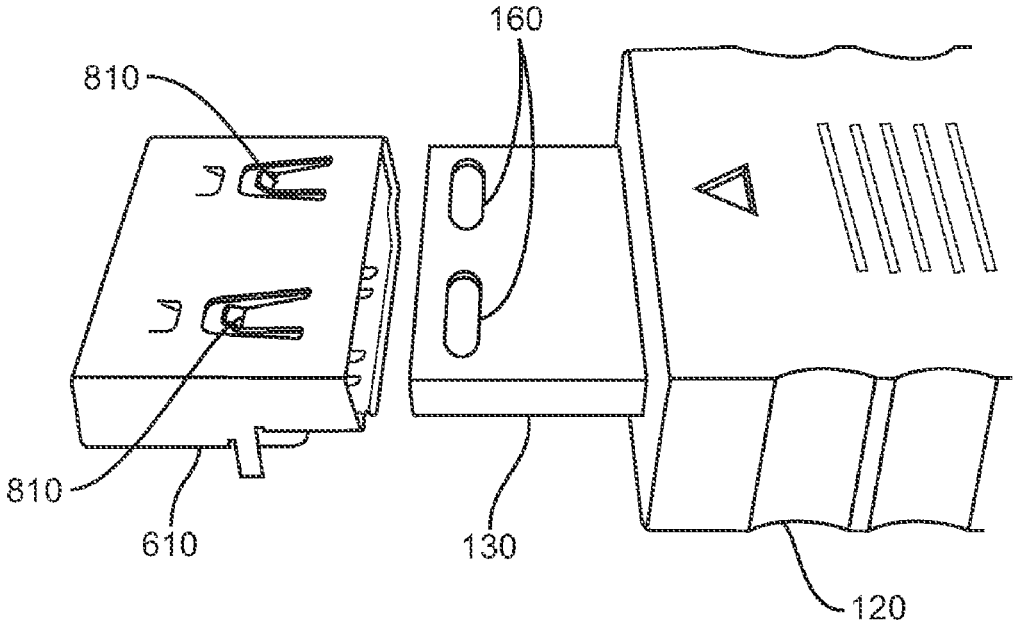
FIG. 8 is another perspective view illustrating an improved-retention HDMI plug and a corresponding HDMI receptacle.
Figure 9:
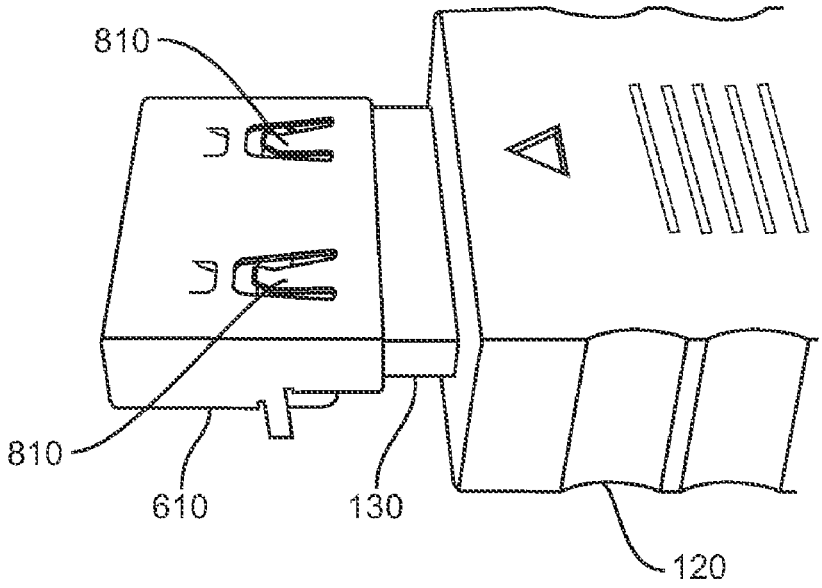
FIG. 9 is a perspective view illustrating the mating between the improved-retention HDMI plug and HDMI receptacle of FIG. 8.

Similar features can be located on the opposite side of the connector body 130 and mating receptacle 610. FIG. 8 is a perspective view of the retention features on the opposite side of connector body 130, illustrating the interaction between the openings 160 and the spring-biased tabs 810 disposed on the mating receptacle 610. As can be seen, each opening 160 is sized and located to accept the corresponding spring-biased tab 810 when the connector is fully inserted, as shown in FIG. 9. The engagement between the openings 160 and the spring-biased tabs 810 increases the force required to extract the connector body 130 from the mating receptacle 610, particularly when these features are used in conjunction with the movable tabs 150 and retention features discussed above.

It should be appreciated that the specific details of the retention features illustrated in FIGS. 1-3 and FIGS. 6-9 are provided as examples only. The specific size, location, and shape of any of these features may be varied, even while the feature retains its essential functions and characteristics. Further, combinations of features other than those specifically illustrated may be used. Thus, the techniques of the present invention may be carried out in ways other than those set forth in the specific embodiments illustrated herein, and the present invention is not limited to the features and advantages detailed in the foregoing description and in the accompanying drawings.

What is claimed is:

1. A high-definition multimedia interface (HDMI) plug comprising:

a connector body having a mating end configured for insertion in a longitudinal direction into a mating HDMI receptacle and having a first slot-shaped opening in a wall of said connector body, extending in the longitudinal direction; and a first movable tab biased to extend outward from the first slot-shaped opening in a first position, when unconstrained by the mating HDMI receptacle, and configured to retreat into a second position, substantially within said opening, when longitudinally engaged by a leading edge of the mating HDMI receptacle during insertion of the connector body therein;

wherein the connector body comprises a first face having a first width, a second face opposite the first face and having a second width greater than the first width, and two ledge portions at first and second sides of the connector body, running in the longitudinal direction, each ledge portion forming a transition between the first width and the second width, and wherein the first slot-shaped opening is disposed on one of the ledge portions so that the first movable tab extends outward towards the first face when in the first position.

2. The HDMI plug of claim 1, further comprising:

a second slot-shaped opening in a wall of said connector body, extending in the longitudinal direction;

and a second movable tab spring-biased to extend outward from the second slot-shaped opening when unconstrained by the mating HDMI receptacle, and configured to retreat into an position substantially within the second slot-shaped opening when longitudinally engaged by the leading edge of the mating HDMI receptacle during insertion of the connector body therein;

wherein the second slot-shaped opening is disposed on a second one of the ledge portions so that the second movable tab extends outward towards the first face when unconstrained by the mating HDMI receptacle.

3. The HDMI plug of claim 1, wherein the first movable tab has a forward edge configured to engage a leading edge of the mating HDMI receptacle during insertion of the connector body therein, wherein said forward edge is disposed at an obtuse angle relative to a ray extending from the first movable tab towards the mating end of the connector body, in the longitudinal direction.

4. The HDMI plug of claim 3, wherein the first movable tab has a trailing edge configured to engage an opening in the mating HDMI receptacle during retraction of the connector body therefrom, wherein said trailing edge is disposed at an obtuse angle relative to a ray extending from the first movable tab away from the mating end of the connector body, along the longitudinal axis.

5. The HDMI plug of claim 1, wherein the connector body further comprises a first opening in the first face, the first opening sized and located to accept a first spring-biased tab of the mating HDMI receptacle upon insertion of the connector body therein.

6. The HDMI plug of claim 1, wherein the connector body further comprises a second opening in the second face, the second opening sized and located to accept a second spring-biased tab of the mating HDMI receptacle upon insertion of the connector body therein.

* * * * *